United States Patent [19]

Eggers

[11] Patent Number: 4,480,211

[45] Date of Patent: Oct. 30, 1984

[54] FLASH LAMP AND CIRCUITRY FOR USE WITH AN INCANDESCENT LIGHT

[75] Inventor: Fredrick W. Eggers, Palos Heights, Ill.

[73] Assignee: Federal Signal Corporation, Oak Brook, Ill.

[21] Appl. No.: 482,603

[22] Filed: Apr. 6, 1983

Related U.S. Application Data

[63] Continuation-in-part of Ser. No. 376,752, May 10, 1982.

[51] Int. Cl.[3] ..... H01J 7/44; H01J 17/34; H01J 19/78; H01J 29/96

[52] U.S. Cl. ..... 315/70; 340/331; 315/57; 315/241 S; 315/178; 315/180; 315/200 A

[58] Field of Search ..... 340/331; 362/200, 204; 313/512; 315/57, 70, 241 S, 178, 180, 181, 196, 200 A

[56] References Cited

U.S. PATENT DOCUMENTS

| | | | |
|---|---|---|---|
| 2,905,863 | 9/1959 | Martin et al. | 315/241 S |
| 2,981,866 | 4/1961 | Tsien et al. | 315/200 |
| 3,530,501 | 9/1970 | Van Benschoten | 340/331 X |
| 3,673,462 | 6/1972 | Girard | 315/200 A |
| 3,675,073 | 7/1972 | Hogue | 315/57 |
| 3,710,182 | 1/1973 | Van Reenen | 315/200 A |
| 3,845,349 | 10/1974 | Liebman | 315/200 A |
| 4,142,179 | 2/1979 | Lowndes | 340/331 |

*Primary Examiner*—Saxfield Chatmon

*Attorney, Agent, or Firm*—Charles F. Pigott, Jr.; George H. Gerstman

[57] ABSTRACT

A flash lamp in which a flash tube, transformer, capacitor and base are coupled together to form a unitary integral lamp. A portion of the flash tube, the transformer and capacitor may be encapsulated by a plotting compound. An electrical circuit consisting of a flash lamp and a conventional incandescent light is also provided for operation in parallel from a remotely located power supply.

4 Claims, 11 Drawing Figures

FLASH LAMP AND CIRCUITRY FOR USE WITH AN INCANDESCENT LIGHT

CROSS-REFERENCE TO RELATED APPLICATION

This application is a continuation-in-part of my U.S. patent application Ser. No. 376,752 entitled "Flash Lamp" and filed on May 10, 1982, the benefit of which filing date is being clamped herein.

BACKGROUND OF THE INVENTION

The present invention concerns a novel flash lamp and flash lamp assembly. The novel flash lamp has particular applications in circuitry for operation in parallel with a conventional incandescent light or lamp.

In emergency lights, such as emergency vehicle light bars, incandescent lamps having a dual contact bayonet base are often used. I have discovered a flash lamp assembly that can be easily substituted for this type of incandescent lamp. It is to be understood, however, that my invention is not limited to use in emergency vehicle light bars. My invention may take various forms in which a simple flash lamp assembly is provided having a two-contact circuit in contrast to the prior art three-contact circuits.

For example, a conventional flash tube has two end contacts which may be designated an anode and a cathode for convenience, although these designations may be arbitrary. The conventional flash lamp also has a trigger electrode, often in the form of a metal band. In conventional prior art flash circuits, all three electrodes must be connected to external circuitry, and thus the prior art flash tube assemblies cannot be merely inserted into an ordinary two-contact receptacle such as used with the conventional incandescent lamp.

In another aspect of my invention, I have developed circuitry in which my improved flash lamp assembly can be operated in parallel with a conventional incandescent lamp so that only a single power supply wire is required for connection. A conventional incandescent lamp and a conventional prior art flash lamp could be operated off the same power supply line only if the power source for the flash lamp was housed in the same package. For purpose of convenience in illustration, a schematic circuit in block diagram form showing this prior art construction is shown in FIG. 9 and has been designated with the legend "Prior Art".

This prior art arrangement suffers from the disadvantage of requiring the mounting of the power source in close proximity to the flash lamp which would be impractical where the flash lamp is installed in a remote location such as on the wingtips of an aircraft. Thus, not only would such construction require additional wiring, it would not be appropriate due to limitations of space and weight.

It is, therefore, an object of the present invention to provide a flash lamp that is insertable into an incandescent lamp receptacle.

Another object of the present invention is to provide a flash lamp in which the flash lamp assembly is formed in a unitary, integral construction.

A further object of the present invention is to provide a flash lamp assembly in which a flash tube, transformer, capacitor and base are coupled together to form a unitary, integral lamp, with all or a portion of the flash tube, the transformer and capacitor being encapsulated by a potting compound.

A further object of the present invention is to provide a flash lamp which is simple in construction and easy to manufacture.

Still another object of the present invention is to provide an electrical circuit including a novel flash lamp assembly and an conventional incandescent lamp connected in parallel and housed in a single package where the power supply for the same is adapted to be located at any desired remote area.

Other objects and advantages of the present invention will become apparent as the description proceeds.

SUMMARY OF THE INVENTION

In accordance with the present invention, a flash lamp is provided which comprises a flash tube having an anode, a cathode and a trigger electrode. A transformer and a capacitor are electrically coupled to the flash tube and a multi-contact lamp base is provided. The anode of the flash tube is connected to another base contact. The flash tube, transformer, capacitor and base all form a unitary integral lamp.

In the illustrative embodiment, the lamp includes potting means encapsulating a portion or all of the flash tube, the transformer and the capacitor. The base has a main hollow metallic body forming a ground contact and having a single centrally-located bottom contact, with the anode connected to the bottom contact and the cathode connected to the ground contact.

In the illustrative embodiment, the flash lamp assembly comprises the flash tube, transformer, capacitor and means connecting the capacitor in series with the transformer primary. One side of the capacitor is connected to one side of the transformer primary and the other side of the capacitor is connected to either the anode or cathode. The other side of the transformer primary is connected to the other electrode of the flash tube. One side of the transformer secondary is connected to the trigger electrode of the flash tube and the other side of the transformer secondary is connected to either the anode or cathode.

The electrical circuit includes the novel flash lamp and a conventional incandescent lamp connected in parallel therewith. A first end of the flash lamp is connected to a diode in series with a first end of the incandescent lamp, and the second end of the flash lamp is connected to the second end of the incandescent lamp. A single power supply wire is connected to the junction of the first end of the flash lamp and the diode in series with the incandescent lamp and to one end of a remotely located power supply.

In a second embodiment of the electrical circuit, a first end of the flash lamp is connected to an inductor in series with a first end of the incandescent lamp, and the second end of the flash lamp is connected to the second end of the incandescent lamp.

A more detailed explanation of the invention is provided in the following description and claims, and is illustrated in the accompanying drawings.

DETAILED DESCRIPTION OF THE ILLUSTRATIVE EMBODIMENTS

Figure 1:
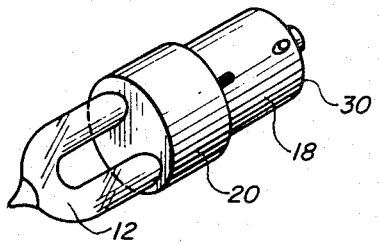
FIG. 1 is a perspective view of a flash tube constructed in accordance with the principles of the present invention.

Referring to FIGS. 1–4 of the drawings, a flash lamp 10 is shown therein comprising a flash tube 12, a transformer 14, a capacitor 16, a contact base 18 and a central body portion 20.

Flash tube 12 may comprise a conventional flash tube having a first electrode 22 which for convenience will be designated an anode, a second electrode 24 which for convenience will be designated a cathode, and a trigger electrode 26 which extends from metal trigger band 28. Although no limitation is intended, flash tube 12 may be General Electric Model FT-106C.

Transformer 14 is preferably a miniature transformer and although no limitation is intended, transformer 14 may comprise a Siemens ZS-1062 transformer. Capacitor 16 is preferably a disc ceramic capacitor and although no limitation is intended, capacitor 16 may comprise a Sprague 5GAS-S10 capacitor.

Base 18 is preferably a metal base having a pair of opposed bayonet pins 30, a centrally positioned electrical contact 32 surrounded by a non-conductive high temperature insulator 34, with the remainder of base 18 forming a ground contact.

Figure 2:
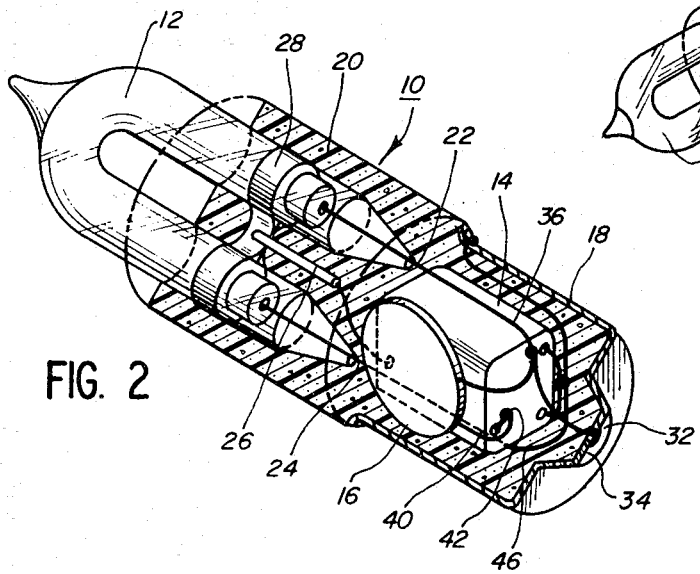
FIG. 2 is an enlarged view thereof, with portions broken away to show the interior thereof.
Figure 3:
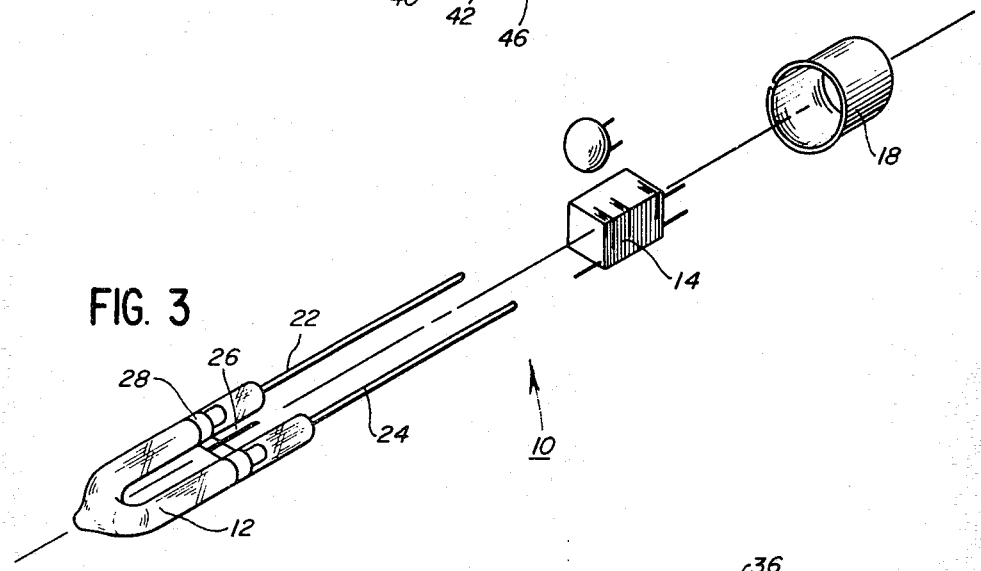
FIG. 3 is an exploded view thereof.
Figure 4:
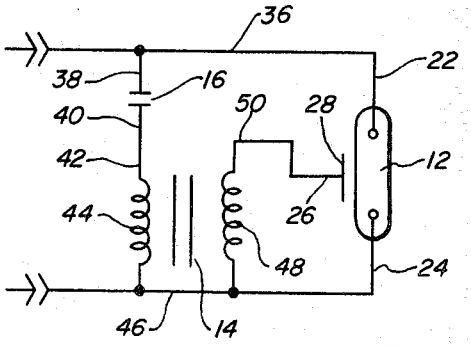
FIG. 4 is a schematic circuit diagram of a flash lamp assembly constructed in accordance with the principles of the present invention.

Referring to FIG. 2, it can be seen that base 18 is hollow to enclose transformer 14 and capacitor 16. Electrical lead 36 couples anode 22 to lead 38 of capacitor 16 while lead 40 of capacitor 16 is connected to one side 42 of transformer primary 44. Lead 46 connects the other side of transformer primary 44 to the ground contact of base 18 and to one side of the transformer secondary 48. Lead 50 connects trigger electrode 26 to the other side of the transformer secondary 48.

Central body portion 20 is formed of a potting compound which fills hollow base 18 to encapsulate transformer 14 and capacitor 16 is therewithin, and to form a portion of the housing for the flash lamp. It can be seen that the flash tube 12, transformer 14, capacitor 16, base 18 and central body portion 20 combine together to form a unitary, integral lamp 10.

Although no limitation is intended, the potting compound which forms central body portion 20 and encapsulates an epoxy resin such as "Sylgard" brand elastomer No. 184 sold by Dow Corning Corp. of Midland, Mich.

It is desirable that base 18 be a conventional incandescent lamp type two-contact bayonet base. In this manner, flash lamp 10 can be easily substituted into a conventional bayonet receptacle for incandescent lamps.

Figure 5:
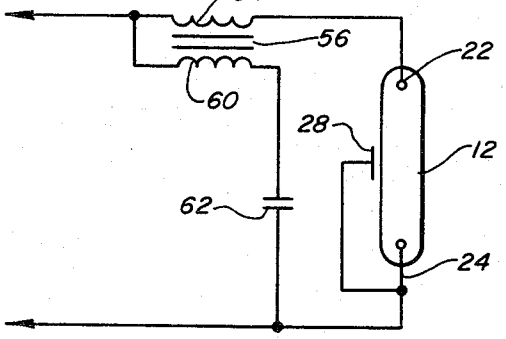

In other forms of the invention, as illustrated in FIGS. 5–8, series injection type flash tube assemblies are provided. As illustrated in FIG. 5, the flash tube anode 22 is connected in series with the primary 54 of a transformer 56, while the cathode 24 and trigger electrode 28 are connected directly to ground line 58. One side of secondary 60 of transformer 56 is connected to primary 54 and the other side of secondary 60 is connected to a capacitor 62 which is connected to ground line 58.

Figure 6:
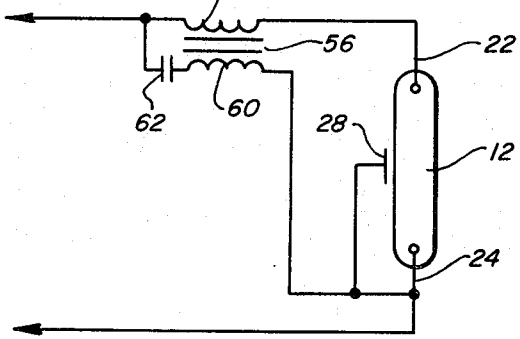
FIGS. 5–8 are schematic circuit diagrams of flash lamp assemblies constructed in accordance with modified forms of the invention.

In the embodiment of FIG. 6, which is similar to the embodiment of FIG. 5, one side of secondary 60 is connected to cathode 24 while the other side of secondary 60 is connected through capacitor 62 to primary 54.

Figure 7:
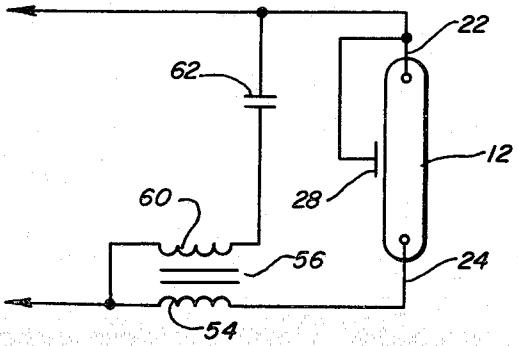
Figure 9:
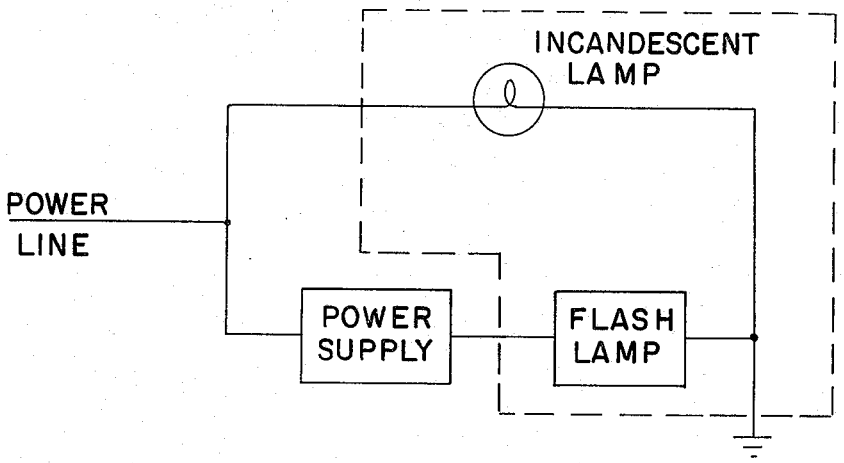
PRIOR ART FIG. 9
FIG. 9 is a schematic circuit in block diagram form, illustrating the prior art construction in which the power source is positioned in close proximity to the conventional flash lamp.

In the FIG. 7 embodiment, primary 54 is in series with cathode 24 of flash tube 12. One side of capacitor 62 is connected to anode 22 while the other side of capacitor 62 is connected to one side of secondary 60. The other side of secondary 60 is connected to primary 54.

Figure 8:
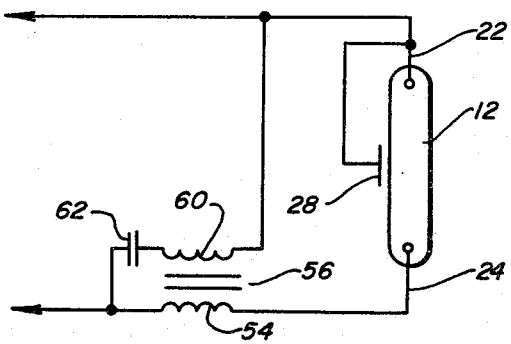

In the FIG. 8 embodiment, which is similar to the FIG. 7 embodiment, one side of secondary 60 is connected to anode 22 while the other side of secondary 60 is connected to one side of capacitor 62. The other side of capacitor 62 is connected to primary 54.

As used in the specification and claims, the terms "anode" and "cathode" are for convenience only. There is no intention for one or the other to be limited to the electrode which is connected to the ground line or the higher voltage line.

Figure 10:
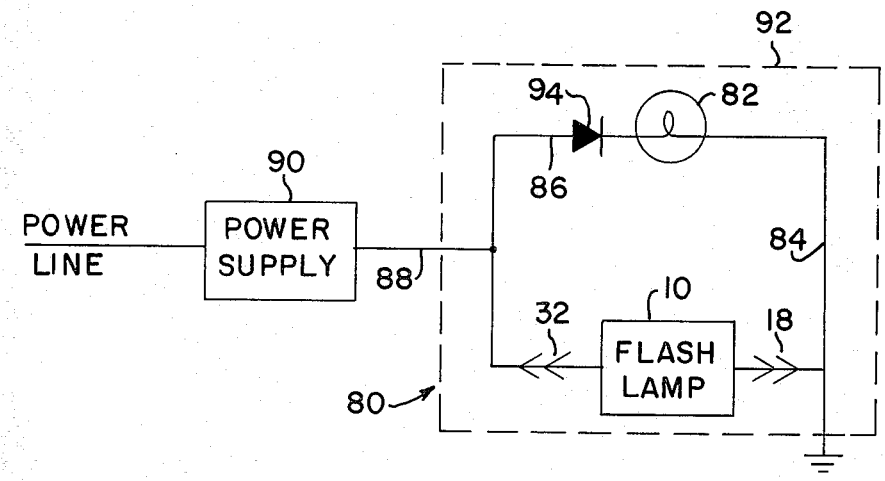
FIG. 10 is a schematic circuit in block diagram form, illustrating an embodiment of the electrical circuit according to the present invention in which the power source is disposed at a remote location.

In FIG. 10, there is shown a schematic circuit in block diagram form according to the present invention. The elements corresponding to those shown in FIG. 1 are designated with similar reference numerals. The electrical circuit 80 includes the novel flash lamp 10 and a conventional incandescent light or lamp 82 coupled in series with a diode 94. The incandescent lamp and the diode 94 are connected in parallel with the flash lamp 10. The base 18 of the lamp which is the ground contact is coupled via lead line 84 to one end of the incandescent lamp 82. The centrally positioned electrical contact 32 of the lamp 10 is coupled via lead line 86 to the anode of the diode 94. The cathode of the diode 94 is connected to the other end of the incandescent lamp 82. A single power supply wire 88 is connected to the juncture of the flash lamp 10 and the anode of the diode 94 and to one end of a power supply 90.

Thus, it can be seen that the flash lamp and the incandescent lamp with series diode may be housed in a single package 92 and are operated in parallel by the same power supply 90 which is disposed at a remote location. Only the single wire 88 is required to make connection between the power supply 90 and the package 92.

Figure 11:
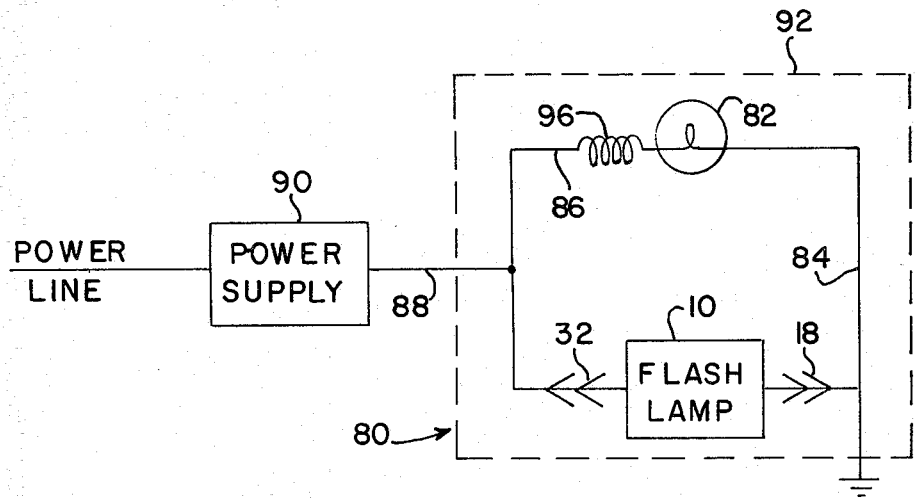
FIG. 11 is a schematic circuit in block diagram form, illustrating another embodiment of the electrical circuit according to the present invention.

In FIG. 11, there is shown another embodiment of the electrical circuit in block diagram form in accordance with the present invention. The elements corresponding to those shown in FIG. 10 are designated with similar reference numerals. Unlike the circuitry shown in FIG. 10, an inductor has been connected in the place of the diode 94. In all other respects, the construction of the circuitry is identical to that of FIG. 10.

In particular, the electrical circuit 80 consists of the novel flash lamp 10 and the conventional incandescent lamp 82 coupled in series with an inductor 96. The incandescent lamp and the inductor 96 are connected in parallel with the flash lamp 10. The base 18 of the lamp 10 which is the ground contact is coupled via lead line 84 to one end of the incandescent lamp 82. The centrally positioned electrical contact 32 of the lamp 10 is coupled via lead 86 to one end of the inductor 96. The other end of the inductor 96 is connected to the other end of the incandescent lamp 82. A single power supply wire 88 is connected to the juncture of the flash lamp 10 and the inductor 96 and to one end of a power supply 90. Similarly, the flash lamp, and the incandescent lamp with series inductor may be housed in a single package 92 and are operated in parallel by the same power supply 90 which is disposed at a remote location.

From the foregoing detailed description, it can thus be seen that the present invention provides an improved flash lamp assembly which is formed in a unitary, integral construction and is adapted for insertion into a conventional incandescent lamp receptacle. Further, there are provided electrical circuits consisting of the improved flash lamp and a conventional incandescent lamp for operation in parallel and housed in a single package where the power supply is disposed at a remote location.

While there has been illustrated and described what is at present to be preferred embodiments of the present invention, it will be understood by those skilled in the art that various changes and modifications may be made, and equivalents may be substituted for elements thereof without departing from the true scope of the invention. In addition, many modifications may be made to adapt a particular situation or material to the teachings of the invention without departing from the central scope thereof. Therefore, it is intended that this invention not be limited to the particular embodiments disclosed as the best modes contemplated for carrying out this invention, but that the invention will include all embodiments falling within the scope of the appended claims.

What is claimed is:

1. A flash lamp and incandescent lamp assembly which comprises:

a flash lamp, said flash lamp having a flash tube with an anode, a cathode and a trigger electrode, said flash lamp being operable to rely on an external timing circuit for the timing of the flashes;

a transformer and capacitor circuit coupled to said anode, cathode and trigger electrode;

a multi-contact lamp base;

means connecting said anode to one base contact and said cathode to another base contact;

said flash tube, transformer and capacitor circuit and said base all forming a unitary, integral lamp without the need for any timing means within the lamp;

an incandescent lamp;

a power supply for supplying power to both said flash tube and said incandescent lamp, with the outlet of the power supply providing energy for both the incandescent lamp and the flash lamp;

a diode having an anode and a cathode;

means connecting said diode between said power supply outlet and said incandescent lamp.

2. A device as described in claim 1, wherein said flash lamp, diode and said incandescent lamp are housed in a single package.

3. A flash lamp and incandescent lamp assembly which comprises:

a flash lamp, said flash lamp having a flash tube with an anode, a cathode and a trigger electrode, said flash lamp being operable to rely on an external timing circuit for the timing of the flashes;

a transformer and capacitor circuit coupled to said anode, cathode and trigger electrode;

a multi-contact lamp base;

means connecting said anode to one base contact and said cathode to another base contact;

said flash tube, transformer and capacitor circuit and said base all forming a unitary, integral lamp without the need for any timing means within the lamp;

an incandescent lamp;

a power supply for supplying power to both said flash tube and said incandescent lamp, with the outlet of the power supply providing energy for both the incandescent lamp and the flash lamp;

an inductor;

means connecting said inductor between said power supply outlet and said incandescent lamp.

4. A device as described in claim 3, wherein said flash lamp, inductor and said incandescent lamp are housed in a single package.

* * * * *